United States Patent [19]

Vano et al.

[11] Patent Number: 4,928,976

[45] Date of Patent: May 29, 1990

[54] WORD QUESTION ASSOCIATION GAME

[76] Inventors: Barbara Vano; Bruno Vano, both of 36324 Moravian, Fraser, Mich. 48026

[21] Appl. No.: 368,413

[22] Filed: Jun. 16, 1989

[51] Int. Cl.[5] ..... A63F 3/00

[52] U.S. Cl. ..... 273/240; 273/272

[58] Field of Search ..... 273/240, 272, 273, 141 R, 273/299, 307; 434/167, 170, 172

[56] References Cited

U.S. PATENT DOCUMENTS

| | | | |
|---|---|---|---|
| 1,512,147 | 10/1924 | Tegtmeyer et al. | 273/272 |
| 1,545,085 | 7/1925 | Davidheiser | 273/141 R |
| 1,555,125 | 9/1925 | Lange | 273/240 |
| 2,380,106 | 7/1945 | Hilton | 273/240 |
| 3,226,122 | 12/1965 | Rogers | 273/240 X |
| 4,592,553 | 6/1986 | Mammen et al. | 273/240 |
| 4,690,409 | 9/1987 | Scalia | 273/141 R X |
| 4,852,885 | 8/1989 | Baratpour et al. | 273/240 X |

*Primary Examiner*—Edward M. Coven
*Assistant Examiner*—William E. Stoll
*Attorney, Agent, or Firm*—Bill C. Panagos

[57] ABSTRACT

The present invention is a word association game for two or more players. The game is played with game score sheet, a timer, a spinner, a category card deck and a play word deck. The players spin the spinner and the one with the highest score is the starter. That person selects a play word from a list which is provided with the game. The word is then revealed to all players who write it across the top of their game score sheet. Each player then spins the spinner to determine which category they are to select a card from and that category is listed in various squares along the side of the score sheet. The players then fill in words associated with that category and beginning with each letter of the play-word in the square over the top of the score sheet. The timer is set for some predetermined period during which the players must try to fill in all the squares under the letters. When the timer signals that time has expired, the players are scored for their responses, and the one with the highest score wins.

3 Claims, 1 Drawing Sheet

WORD QUESTION ASSOCIATION GAME

BACKGROUND OF THE INVENTION

1. Field of the Invention

The present invention relates to a word association game and method for playing the game. The present invention further relates to a word association game wherein the players contrive words associated with various categories which are selected from category cards and which are filled in on a game sheet. The present invention further relates to a word association game which is played with category cards, timer, game sheets and a means to randomly select the subject category which the players will try to associate words with.

2. Description of the Related Art.

Tegtmeyer et al, U.S. Pat. No. 1,512,147 disclose an educational game for children which will teach them to spell words correctly. In playing the game, the child selects any one of several cards which are divided into rows and columns. The cards have categories or symbols associated with each square in a column. A box is provided which contains all the letters necessary to spell the words associated with the various symbols.

In playing the game, the child selects a game card and then withdraws the letters from the box and fills in the letters on the game sheet. When a letter is drawn which is not on the child's game sheet, he/she places that letter tile back into the box a passes the turn to the next player. The player who correctly spells all the words on his/her list first wins the game.

Davidheiser, U.S. Pat. No. 1,545,085 discloses a game comprised of a game board, a set of bird cards and a spinner. This equipment is capable of being used in three separate games, call convey, school and election, respectively. The games are similar in that the cards are placed on the counter in their respective series and in alphabetical order. The players take turns spinning the spinner, which comes to rest upon one of the letters on the spinner. The letter indicates which series from which the player must draw his card, and the player who collects all his game cards is the winner.

Krause, U.S. Pat. No. 3,606,336 discloses a word association game which includes the use of a spinner and a timer. The players spin the spinner and select the letters indicated by the spinner and try to form words in the time alloted by the timer. Each word is formed at right angle to each other and uses a letter from the word which preceded it on the game table. In addition, the words so formed must have an association with the preceding word with which it is connected.

Scalia, U.S. Pat. No. 4,690,409 discloses a game for selecting and arranging letters. The game includes an indicator board which has a pointer and a second pointer which indicates the letter. Letter tiles are also included. The game is played by randomly selecting the number of letters that can be used in a player's turn and then spinning the pointer for the letters and using the letter so indicated to arrive at words or contractions of words. The players are given scores based on the words played and the highest score wins the game.

SUMMARY OF THE INVENTION

The present invention is a word association game for two or more players. The game is played with game score sheet, a timer means, a spinning means, a category card deck and a play word deck. The players spin the spinner and the one with the highest score is the starter.

That person selects a play word from a list which is provided with the game. The word is then revealed to all players who write it across the top of their game score sheet. Each player then spins the spinner to determine which category they are to select card from and that category is listed in various squares along the side of the score sheet. The players then fill in words associated with that category and beginning with the letter of the playword in the square over the top of the score sheet. The timer is set for some predetermined period during which the players must try to fill in all the squares under the letters. When the timer signals that time has expired, the players are scored for their responses and the one with the highest score wins.

BRIEF DESCRIPTION OF THE DRAWINGS

The present invention will be more clearly understood by reference to the following detailed description when read in conjunction with the accompanying drawings in which like reference characters refer to like parts throughout the views and in which.

DETAILED DESCRIPTION OF THE PREFERRED EMBODIMENT

The present invention relates to a game for two or more players which is a word association game, ages 12 to adult. The game has play word cards, a spinner, score game sheets, pencils and a timer.

Figure 1:
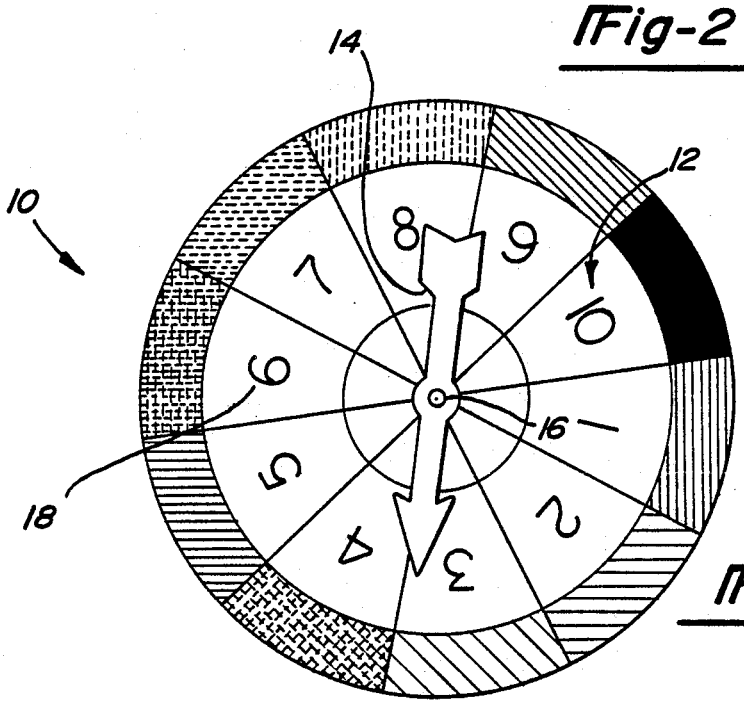
FIG. 1 is a plan view of a portion of the game apparatus for randomly selecting the categories to be played and the order of play.

Referring to FIG. 1, the game apparatus for randomly selecting the categories to be played and the order of play is shown as spinner 10. The spinner is multi-colored, and pie sectioned off into various sections 12, each one being a different color. A pointer 14 is rotatably attached to the center of the spinner by attachment means 16 which allows for the free rotation of the pointer over the spinner in a manner well known to those skilled in the art. Each colored section has a numerical value 18 attached to it and when the pointer stops at the various colored sections, the players use that color to select category cards from the category card selection.

The play cards have different words written on them and the category cards have different categories written on them.

Figure 2:
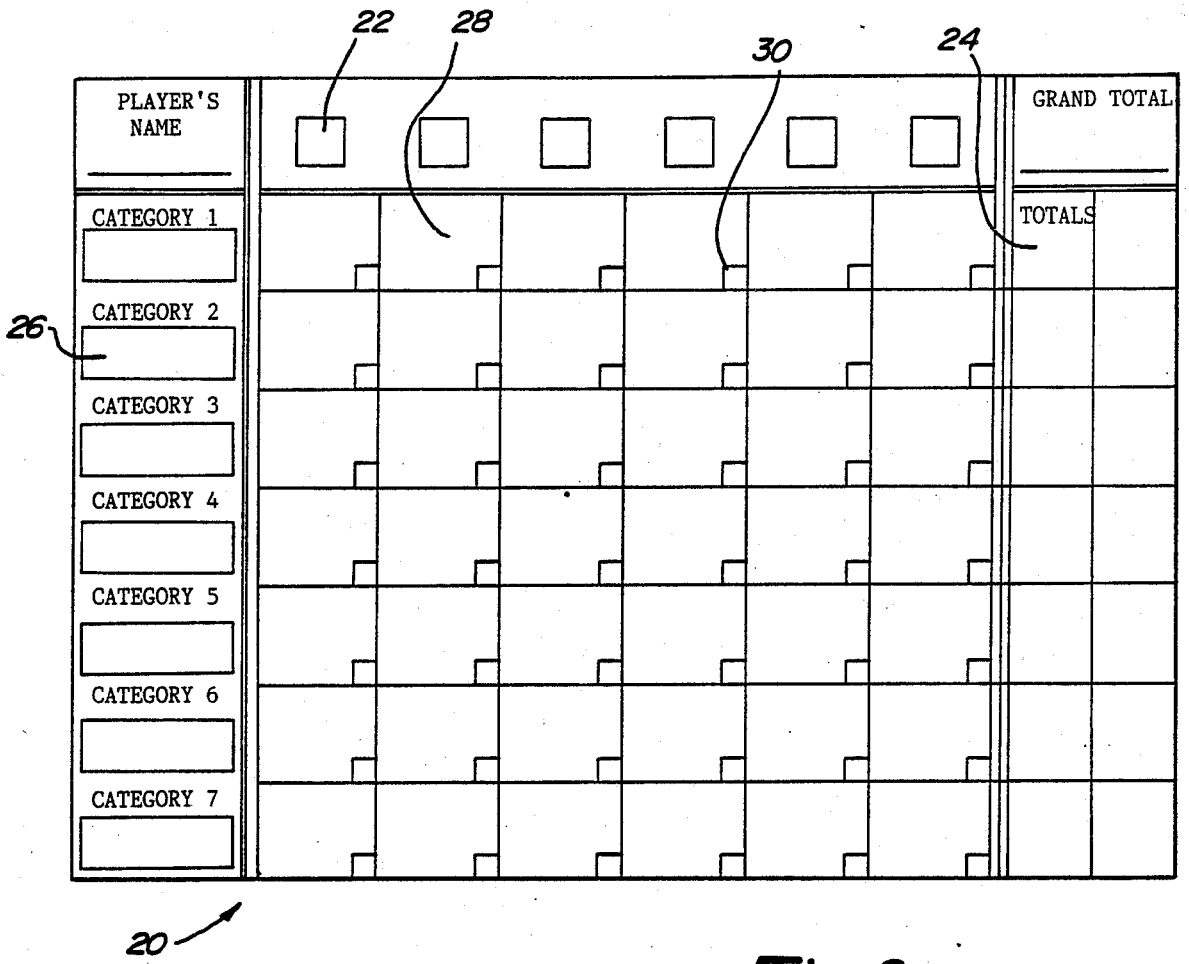
FIG. 2 is top view of the game score sheet.

Referring to FIG. 2, the game sheet 20 has a plurality of squares 22 laid out across the top of the sheet and a place for the player's name. Down along one side of the game sheet are a plurality of squares 24 to write the totals of the player's scores, and down the opposite side of the sheet are a plurality of squares 26 for writing in the categories. Under each square across the top of the sheet are a plurality of squares 28 for the players to write words in. Each square is provided with an area 30 in which to write the score associated with that particular word.

To play the game, each player spins the spinner to determine the starter. The person with the highest point score from the spinner is the starter. That person then draws a card from the play word card deck and reveals that word to the other players. The players then write that word across the top of their score game sheet, with each letter in a subsequent box across the sheet.

Each player then spins the spinner to determine which category they must play. The categories are color coded and correspond to the colors on the spinner. The players then select the cards from the category and reads it to the other players. Each player then writes the category in a box along the side of the game sheet. The players continue, each in his own turn, to select category cards based upon the spin color they have been randomly given by the spinner, until all the boxes along one side of the game sheet are filled in.

A time for play is then set, preferably on a timer means, for a predetermined time, during which time the players fill in as many of the squares under the play word on the game sheet as possible. For example, if the playword was "CANDLE" and the category was "MAMMALS", a player might write "COUGAR" in the square under the letter "C" in "CANDLE", and so on, with each letter in the word "CANDLE" beginning the word in the selected and written on the game sheet for that particular square. The game ends when the timer sounds, indicating that the players must stop writing words in the squares.

The players announce the words they have written into the square under each letter of the word they have written across the top of the game sheet. If as player's answer is not duplicated by any other player, he receives full credit for the answer. If the answer is duplicated by another player, those players having the same answers receive only partial credit. If there is a dispute as to whether an answer is correct, i.e., whether the word fits the category under which it is placed, resort to a dictionary or other reference material can be had, or the players can settle the dispute as between themselves.

Having thus described our invention, many modifications will become apparent to those skilled in the art without departing from the scope and spirit of the appended claims.

We claim:

1. A method for playing a word association game for at least two players, comprising:

(a) spinning a pointer rotatably attached to a multicolored, pie sectioned spinner having each pie section a different color and having a numerical value associated with each color to randomly determine a starter, said starter being the player with the highest score on the spinner;

(b) selecting a word from a play word list and revealing that word to the other players, said starter selecting the word, and having the each player write that word on a game score sheet, said sheet having a first plurality of squares arranged in a row across the top of said sheet, each square having space for a single letter, said sheet further having a second plurality of squares arranged vertically in columns under each of said first plurality of squares and in rows in relation to each other horizontally, said second plurality of squares further having an area therein to write a partial score for the letter played, said game sheet further provided with a first plurality of boxes arranged in a column along one side of the sheet, said first boxes designated as category and arranged so that horizontally they form a row with the said second plurality of squares, said sheet further provided with a second plurality of boxes arranged in a column along the opposite side of said sheet, said second plurality of boxes arranged so that horizontally they form a row with the said second plurality of squares;

(c) having each player spin the spinner and select a category card based upon the color indicated by the random spin of the spinner, each player proceeding successively in this manner until all the categories are selected, each player writing the categories into the said first plurality of boxes on the game sheet;

(d) filling the second plurality of squares with words associated with the category corresponding to that row on the game sheet and beginning with the letter indicated in the square of the first plurality of squares which corresponds to the column in which the second square is situated;

(e) stopping the game at some predetermined time and determining the score each player has earned by totalling the points earned for the words each player has selected in the second plurality of squares.

2. The method of claim 1, wherein said time is determined by a timing device.

3. The method of claim 1, wherein said players receive full credit when the words in said second plurality of squares are not duplicated by another player, and only partial credit for words which are duplicated by another player.

* * * * *